United States Patent [19]

Swihart

[11] 4,324,720

[45] Apr. 13, 1982

[54] LUBRICANT-BEARING FIBERS AND LUBRICANT COMPOSITIONS THEREFOR

[75] Inventor: Terence J. Swihart, Essexville, Mich.

[73] Assignee: Dow Corning Corporation, Midland, Mich.

[21] Appl. No.: 189,494

[22] Filed: Sep. 22, 1980

[51] Int. Cl.[3] ..... C08L 91/00; D06M 13/18; D06M 15/66

[52] U.S. Cl. ..... 260/185; 252/8.9; 252/49.6; 428/290

[58] Field of Search ..... 252/8.9; 427/387; 428/290; 260/29.2 M, 185

[56] References Cited

U.S. PATENT DOCUMENTS

| | | | |
|---|---|---|---|
| 3,867,188 | 2/1975 | Campbell et al. | 117/138.8 |
| 3,997,450 | 12/1976 | Steinmiller | 252/8.9 |
| 4,105,567 | 7/1978 | Koerner et al. | 252/8.6 |
| 4,169,905 | 10/1979 | Delaval et al. | 427/387 |

*Primary Examiner*—Maria Parrish Tungol

*Attorney, Agent, or Firm*—George A. Grindahl

[57] ABSTRACT

Fiber lubricant compositions having unusual lubricating properties for spunbonded, nonwoven polypropylene carpet backing are disclosed. A needle-tufted carpet, prepared from a carpet backing bearing a composition of this invention, has unexpectedly high strength and unexpectedly low flammability. The compositions of this invention comprising a mixture of butyl stearate and certain silicone-glycol copolymers, are useful as a lubricant for synthetic fibers, in general.

12 Claims, No Drawings

LUBRICANT-BEARING FIBERS AND LUBRICANT COMPOSITIONS THEREFOR

BACKGROUND OF THE INVENTION

The present invention relates to a fiber lubricant composition which is particularly useful for lubricating a spunbonded nonwoven fabric and to fibers and fabrics having said lubricant composition thereon.

More specifically the fiber lubricant composition of this invention consists essentially of a synergistic mixture of certain silicone-glycol copolymers and butyl stearate which, when applied to spunbonded nonwoven polypropylene carpet backing, provides unexpectedly good lubrication for needle-tufting of the backing and an unexpectedly low flammability of a tufted carpet produced therefrom.

A spunbonded fabric is a continuous filament nonwoven fabric made by combining all the steps from polymer preparation to finished fabric in one process. Curtains of polymer filaments are extruded, drawn, forwarded to a belt and combined there into a web with the required design. The web is then bonded and can be finished in the same single process.

The basic process steps for making spunbonded nonwoven fabrics are quite simple. Multiple spinnerettes extrude large numbers of polymer filaments which are drawn and oriented in groups, by rolls or by high velocity air, and then projected, in some desired geometrical array, as a web onto a slowly moving porous belt provided with suction to hold the web. The belt then carries the web to a bonding operation such as binder application and/or heater rolling and then to one or more further operational steps in the process. These latter steps can be the traditional textile finishing steps such as printing or embossing when process speeds are compatible.

There are many spunbonded nonwoven fabrics available commercially. Examples of such materials are those based on synthetic fibers, such as polyesters, polyamides and polyolefins, such as polypropylene, polyethylene, or combinations of the foregoing. The particular fiber type used will depend on the nature of the finished product one wishes to make. Each uses for spunbonded nonwoven fabrics ranges from such things as book covers, to clothing fabric to carpet backing.

One of the most significant commercial uses of spunbonded nonwoven fabric is the use of spunbonded nonwoven polypropylene as a carpet backing. The spunbonded nonwoven polypropylene fabric has been substituted for the woven jute backing materials that have been used heretofore in the production of carpets.

In this use the carpet yarn is threaded through a suitably large needle which is then punched through the spunbonded nonwoven polypropylene fabric, designated as the primary backing. A looper device catches the yarn on the opposite side of the backing to form loops or tufts and the yarn and needle are then withdrawn to complete the formation of the loop or tuft. The backing fabric is then advanced and the cycle is repeated to form additional tufts. The tufts make up the pile or face of the final carpet. A commercial tufting machine may have up to 2400 needles in a row all working in unison to make a carpet up to 15 feet in width.

The primary backing, which is the spunbonded nonwoven polypropylene fabric, is the structural base of the carpet. It holds the tufts in place and provides dimensional stability and strength to the carpet. To the back of the tufted spunbonded nonwoven polypropylene backing there is applied a glue, for example a latex of natural rubber or styrene-butadiene rubber, which coating firmly anchors the tufts in place and keeps them from pulling out. A jute or foam back may then be placed on the glued carpet backing to act as a pad or cushion.

In the development of this use of the spunbonded nonwoven fabric it was found that the needles did extensive damage to the carpet backing on penetration of the structure, resulting in a large loss in strength during the tufting process.

Campbell, et al., U.S. Pat. No. 3,867,188 discovered that when certain silicone-glycol copolymers were applied to the spunbonded nonwoven polypropylene backing the penetration of the needle therethrough in the tufting process was facilitated and the backing damage and its attendant loss of strength could be significantly reduced.

Useful as Campbell et al's discovery is, it suffers from a drawback common to previous processes comprising using a silicone as a lubricant for spunbonded nonwoven carpet backing, i.e. increased flammability of certain carpeting produced therefrom. It appears that as the carpet yarn is punched through a carpet backing that has been lubricated with a silicone-containing composition it picks up some of the lubricant composition, thereby resulting in a carpet having the lubricant composition on its facing as well as on its backing. It is thought that, at certain levels of add-on, silicone compositions are responsible for the enhanced flammability of some thermoplastic yarn materials, that is demonstrated in some testing procedures.

SUMMARY OF THE INVENTION

It is an object of this invention to provide a silicone-glycol-containing composition which is useful for lubricating spunbonded nonwoven carpet backing but which does not increase the flammability of a carpet prepared by needle-tufting a spunbonded nonwoven carpet backing treated therewith. It is a further object of this invention to provide an improved spunbonded nonwoven polypropylene carpet backing. It is another object of this invention to provide an improved spunbonded nonwoven fabric. It is an additional object of this invention to provide an improved fiber.

These objects, and others which will become obvious to one considering the following specification and appended claims, are obtained by preparing a mixture consisting essentially of from 1.0 to 9.0 parts by weight of butyl stearate and 1.0 parts by weight of the silicone-glycols disclosed by Campbell et al. in U.S. Pat. No. 3,867,188 and applying the resulting composition to a fiber, such as those of a spunbonded nonwoven fabric.

It was surprising to discover that such a mixture, when applied to a spunbonded nonwoven polypropylene carpet backing at a concentration of approximately 1 percent by weight, based on the weight of the carpet backing, would not increase the flammability of a carpet prepared from the resulting polypropylene backing.

While this invention is not to be limited by theory, it is believed that the compositions of this invention operate, with respect to their carpet flammability behavior, by simply allowing a small amount of silicone-glycol copolymer to be applied to the polypropylene carpet backing, thereby not contributing to the flammability of a carpet produced therefrom.

However, it was completely unexpected to find that the compositions of this invention provide a level of lubrication of the spunbonded nonwoven carpet backing which exceeds that obtained when either butyl stearate or the silicone-glycols of Campbell et al. noted above are applied alone to the spunbonded nonwoven backing.

DETAILED DESCRIPTION OF THE INVENTION

This invention relates to a composition consisting essentially of (a) 1.0 part by weight of a silicone-glycol copolymer having the formula $$(CH_3)_3SiO\{(CH_3)_2SiO\}_x\{(CH_3)(G)SiO\}_ySi(CH_3)_3$$

wherein G denotes a silicon-bonded radical having the formula $—R(OC_3H_6)_zOH$, R denotes an alkylene radical containing from 1 to 18 carbon atoms, x has an average value of from 40 to 90, y has an average value of from 1 to 10 and z has an average value of from 1 to 10, and (b) from 1.0 to 9.0 parts by weight of butyl stearate.

This invention also relates to a spunbonded nonwoven fabric having thereon a composition of this invention.

This invention further relates to a spunbonded nonwoven polypropylene carpet backing having thereon an amount of the compositions of this invention, said amount being sufficient to place on the carpet backing from 0.05 to 0.5 parts by weight, based on 100 parts by weight of the carpet backing, of the silicone-glycol copolymer component in the compositions of this invention.

This invention still further relates to a fiber having thereon a composition of this invention.

The silicone-glycol copolymer which is used in the compositions of this invention is a trimethylsilyl end-blocked siloxane which contains from 40 to 90 dimethylsiloxane units and from 1 to 10 methylglycolsiloxane units. The copolymers useful herein are water-insoluble because the water-soluble silicone-glycol copolymers, when used in the preparation of needle-tufted carpet, allow the subsequently applied latex glue to wet and penetrate the polypropylene backing too far, resulting in a poor carpet.

The glycol radicals of the methylglycolsiloxane units are represented in the copolymer formula by the symbol G which is more specifically defined as having the formula $—R(OC_3H_6)_zOH$. The R radical in this formula can be any alkylene unit containing from 1 to 18 carbon atoms. Thus, for example, R can be a methylene, ethylene, propylene, butylene, isobutylene, hexylene, decylene, dodecylene or an octacdecylene radical. The glycol portion represented by the $(OC_3H_6)_z$ portion of the structure is, as can be seen from the formula, an oxypropylene radical. The glycol radical is hydroxyl end-blocked or, as is commonly stated in the art, an uncapped glycol. As indicated there can be an average of from 1 to 10 oxypropylene units making up the glycol portion of the structure, i.e., z has an average value of from 1 to 10. It is preferred, however, that z have an average value of from 1 to 5.

The average number of methylglycolsiloxane units in the silicone-glycol copolymer can range from 1 to 10 which is to say y can have an average value from 1 to 10. However, it is generally preferred that the average value of y be in the range of from 1 to 5. The subscript x can have an average value of from 40 to 90, but preferably ranges in value from 50 to 75. The subscript x defines the average number of dimethylsiloxane units in the silicone-glycol copolymer.

Based on the disclosure of the structure herein the preparation of the silicone-glycol copolymer set forth above will be obvious to those skilled in the art of the preparation of such materials. Preferably said silicone-glycol copolymer is prepared by first preparing a siloxane of the structure $Me_3SiO(Me_2SiO)_x(MeHSiO)_ySiMe_3$ in the well-known manner and thereafter reacting therewith, in the presence of a platinum-containing hydrosilylation catalyst, an unsaturated glycol such as a glycol having the formula $CH_2{=}CHCH_2(OC_3H_6)_zOH$, in sufficient quantity to react with all silicon-bonded hydrogen atoms on the siloxane. The resulting silicone-glycol copolymer is substantially free of silicon-bonded hydrogen radicals.

A preferred siloxane-glycol copolymer component in the compositions of this invention has the formula $$(CH_3)_3SiO\{(CH_3)_2SiO\}_{67}\{(CH_3)(HO(C_3H_6O)_{2.5}-CH_2CH_2CH_2)SiO\}_3Si(CH_3)_3.$$

Examples of other suitable silicone-glycol copolymers useful herein include $$Me_3SiO(Me_2SiO)_{40}(\underset{\displaystyle CH_2CH_2CH_2OC_3H_6OH}{\underset{|}{MeSiO}})SiMe_3$$

$$Me_3SiO(Me_2SiO)_{50}(\underset{\displaystyle CH_2CH_2CH_2(OCH(CH_3)CH_2)_3OH}{\underset{|}{MeSiO}})_5SiMe_3$$

$$Me_3SiO(Me_2SiO)_{75}(\underset{\displaystyle (CH_2)_3(OC_3H_6)_5OH}{\underset{|}{MeSiO}})_5SiMe_3$$

$$Me_3SiO(Me_2SiO)_{90}(\underset{\displaystyle (CH_2)_3(OC_3H_6)_{10}OH}{\underset{|}{MeSiO}})_{10}SiMe_3$$

$$Me_3SiO(Me_2SiO)_{65}(\underset{\displaystyle (CH_2)_{18}(OC_3H_6)_8OH}{\underset{|}{MeSiO}})_4SiMe_3$$

$$Me_3SiO(Me_2SiO)_{20}(\underset{\displaystyle CH_2CH(CH_3)CH_2(OC_3H_6)_5OH}{\underset{|}{MeSiO}})_7SiMe_3$$

Butyl stearate is a well-known oleaginous liquid which is soluble in alcohol but substantially insoluble in water. It is commercially available in various grades such as technical grade, cosmetic grade and chemically pure grade. All of these grades of butyl stearate are suitable for use in this invention. Butyl stearate is a well-known component of fiber lubricant, polish, coating, cosmetic, pharmaceutical and textile-treating compositions. Its identity and uses need no further elaboration here.

The compositions of this invention are single phase, homogeneous mixtures which can be prepared by any suitable method, such as by simple, but thorough, mixing of the components thereof.

The compositions of this invention may contain non-essential components such as volatile diluents to provide emulsions or solutions thereof and trace amounts of colorants, odorants and other adjuvants which are common to textile-treating compositions.

A preferred composition of this invention for treating spunbonded nonwoven carpet backing consists essentially of 1.0 part by weight of the preferred siloxane-glycol copolymer, detailed above, and $2\frac{1}{3}$ parts by weight of butyl stearate.

The compositions of this invention can be applied to a fiber or to a fabric by any of the well-known techniques such as padding, rolling, spraying and dipping. To assure a desirable degree of fiber-bonding, the fibers of a spunbonded fabric, such as those of a carpet backing, should be treated with the compositions of this invention after the fiber-bonding operation has been completed.

The amount of the compositions of this invention that is applied to the fiber or fabric will depend to some extent on the desired results but generally speaking will fall within the range of 0.1–10 percent by weight based on the weight of the fiber or fabric. However, it is believed that generally an amount in the range of 0.5–5 percent will meet most needs.

To confer desirable reduced-flammability characteristics to a polypropylene carpet made from a spunbonded nonwoven carpet backing of this invention the composition of this invention should be applied to the carpet backing in an amount that will place, on the carpet backing, from 0.05 to 0.5 parts by weight of the silicone-glycol component for every 100 parts by weight of the spunbonded nonwoven carpet backing.

The compositions of this invention are useful for lubricating synthetic fibers, such as monofilament threads, polyfilament threads, yarns and tows and staple that are used to prepare woven, knitted and sewn fabrics. The compositions of this invention can be applied to a fiber before or after it is used to prepare a woven, knitted or sewn fabric.

The following examples are disclosed to further illustrate, but not limit, the present invention. All parts and percentages are by weight unless otherwise stated. Me denotes the methyl radical. Percent pick-up for fiber-lubricating composition by the carpet backing is based on the weight of the carpet backing.

Pill Test

Flammability of a needle-tufted carpet sample was measured by this test wherein a methenamine fuel pill is placed in the center of a 12"×12" carpet sample, previously dessicated and placed on a flat horizontal support, and ignited. A pass rating is given to the carpet if the region of burning does not extend beyond a distance of three inches from the pill.

Tongue Tear Test (TTT)

Lubrication of a needle-tufted carpet sample was measured by this test. Higher values of TTT show greater lubrication of the backing.

The tufted non-woven sheet is cut into a sample 6 inches wide (cross-machine direction, across tufting rows) and 8 inches long (machine direction, along tufting rows). The sample is cut in the center of the width 4 inches in the machine (tufting) direction. The sample is mounted in an "Instron" tester using 1.5 inch by 2 inch serrated clamps. With a jaw separation of 3 inches, one side of the sample cut is mounted in the upper jaw and the other side of the sample cut is mounted in the lower jaw. The sample is uniformly spaced between the jaws. The full scale load is adjusted to a value greater than the tear strength expected for the sample. Using a cross head speed of 12 inches per minute and a chart speed of 10 inches per minute, the "Instron" is started and the sample is torn. An average of the three highest stresses during tearing is taken. The tongue tear strength in pounds is reported as this average divided by 100 and multiplied by the full scale load. In general several determinations are made and the average reported.

Tufted Grab Tensile (TGT)

Effective lubrication of a carpet backing to reduce fiber breaking during needle-tufting without reducing tuft retention is measured by this test. Higher values of TGT show greater lubrication fo the backing.

A tufted sample is cut into samples 4 inches wide by 6 inches long in the tufting direction. The sample is mounted in an "Instron" using a 1 inch by 2 inch clamp on the back side and a 1 inch square clamp on the front side at a jaw separation of 3 inches. A crosshead speed of 12 inches per minute is used. The peak of the "Instron" curve is read and reported as pounds breaking strength.

EXAMPLES

A silicone-glycol copolymer having the approximate average formula $$Me_3SiO(Me_2SiO)_{67}(\underset{\displaystyle CH_2CH_2CH_2(OC_3H_6)_{2.5}OH}{\underset{|}{MeSiO}})_3SiMe_3$$

was mixed in various amount with five portions of butyl stearate to provide five compositions of this invention containing 9, 4, $2\frac{1}{3}$, $1\frac{1}{2}$ and 1 parts, respectively, of butyl stearate for every part of siloxane-glycol copolymer.

Seven pieces of spunbonded nonwoven polypropylene carpet backing, designated as Typar®-3301 by E. I. DuPont de Nemours and Co., Inc., were coated, using a gravure roll, with one of the above compositions of this invention or butyl stearate or the silicone-glycol copolymer noted above. An eighth sample of carpet backing was not coated.

The coated and noncoated carpet backing samples were needle-tufted with a 1/10 guage needle fitted with 2600 denier Herculon® brand polypropylene yarn, 10 tufts per inch, to provide a carpet sample having a pile height of $\frac{1}{4}$". The resulting carpet samples were examined for flammability, using the Pill Test, and for lubricity using the Tufted Tear Tensile and Tufted Grab Tensile tests, all described above. These samples and test data are summarized in the Table.

The compositions of this invention (reference numbers 2 through 6) provide a greater amount of lubrication, as measured by the Tufted Grab Tensile Test than either of their components (reference numbers 1 and 7). Those carpet samples that were prepared from fabrics of this invention having no more than 0.5 percent silicone-glycol copolymer on the fabric (reference numbers 2 through 5) were no more flammable than the control carpet or the carpet having only butyl stearate on its backing (reference number 1).

TABLE

| Ref. No. | Carpet-Backing Finish: Composition, parts: Silicone-glycol | Butyl stearate | Pick-up, % | Test Results: Flammability, No. Pass/No. Fail | Tufted Grab Tensile, lbs. | Tufted Tear Tensile, lbs. |
|---|---|---|---|---|---|---|
| Control | 0 | 0 | 0 | 8/0 | 16 | $7\frac{1}{2}$ |
| 1(1) | 0 | 1 | 1.8 | 8/0 | 34 | 21 |

TABLE-continued

| Ref. No. | Carpet-Backing Finish Composition, parts Silicone-glycol | Butyl stearate | Pick-up, % | Test Results Flammability, No. Pass/No. Fail | Tufted Grab Tensile, lbs. | Tufted Tear Tensile, lbs. |
|---|---|---|---|---|---|---|
| 2 | 1 | 9 | 1.2 | 8/0 | 64 | 27 |
| 3 | 1 | 4 | 1.2 | 8/0 | 75 | 35 |
| 4 | 1 | $2\frac{1}{3}$ | 1.0 | 8/0 | 83 | 39 |
| 5 | 1 | $1\frac{1}{2}$ | 1.2 | 8/0 | 70 | 41 |
| 6 | 1 | 1 | 1.5 | 5/3 | 64 | 42 |
| 7(1) | 1 | 0 | 1.2 | 4/4 | 56 | 40 |

(1)Reference numbers 1 and 7 are for comparative purposes only.

That which is claimed is:

1. A composition consisting essentially of (a) 1.0 part by weight of a silicone-glycol copolymer having the formula $$(CH_3)_3SiO\{(CH_3)_2SiO\}_x\{(CH_3)(G)SiO\}_ySi(CH_3)_3$$

wherein

G denotes a silicon-bonded radical of the formula $-R(OC_3H_6)_zOH$,

R denotes an alkylene radical containing from 1 to 18 carbon atoms, x has an average value of from 40 to 90, y has an average value of from 1 to 10, and z has an average value of from 1 to 10, and (b) from 1.0 to 9.0 parts by weight of butyl stearate.

2. A composition as defined in claim 1 wherein R contains from 3 to 6 carbon atoms, x has an average value from 50 to 75, y has an average value from 1 to 5, and z has an average value from 1 to 5.

3. A composition as defined in claim 2 wherein R contains 3 carbon atoms, x has an average value of about 67, y has an average value of about 3, and z has an average value of about 2.5.

4. A spunbonded nonwoven fabric having thereon a composition defined by claims 1, 2 or 3.

5. A fabric as defined by claim 4 which is selected from the group consisting of polyester fabrics and polyolefin fabrics.

6. A fabric as defined by claim 5 which is a polyolefin fabric.

7. A polyolefin fabric as defined by claim 6 which is selected from the group consisting of polyethylene fabrics and polypropylene fabrics.

8. A polyolefin fabric as defined by claim 7 which is a polyethylene fabric.

9. A polyolefin fabric as defined by claim 7 which is a polypropylene fabric.

10. A polypropylene fabric as defined by claim 9 which is a spunbonded nonwoven carpet backing.

11. A carpet backing as defined by claim 10 which has thereon from 0.05 to 0.5 parts by weight of the silicone-glycol copolymer for every 100 parts by weight of the carpet backing.

12. A synthetic fiber having thereon a composition defined by claims 1, 2 or 3.

* * * * *